US006199406B1

(12) United States Patent
Rau

(10) Patent No.: US 6,199,406 B1
(45) Date of Patent: Mar. 13, 2001

(54) SMALL DIAMETER GATHERING SHOE FOR GLASS FIBER FORMING

(75) Inventor: Robert B. Rau, Allison Park, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 09/291,742

(22) Filed: Apr. 14, 1999

(51) Int. Cl.[7] ..... L03B 37/03
(52) U.S. Cl. ..... 65/453; 65/500; 65/535; 65/536
(58) Field of Search ..... 65/500, 442, 453, 65/479, 539, 535, 536

(56) References Cited

U.S. PATENT DOCUMENTS

| | | | | |
|---|---|---|---|---|
| 2,972,370 | | 2/1961 | Walbolt | 154/1.7 |
| 3,168,390 | * | 2/1965 | Theobald | 65/500 |
| 3,298,809 | | 1/1967 | Barch et al. | 65/106 |
| 3,335,046 | | 8/1967 | Current et al. | 156/441 |
| 3,997,306 | | 12/1976 | Hedden | 65/3 C |
| 3,999,970 | | 12/1976 | Barch et al. | 65/2 |
| 4,042,360 | * | 8/1977 | Kane | 65/500 |
| 4,071,341 | | 1/1978 | Bohy et al. | 65/11 W |
| 4,252,550 | | 2/1981 | Schlachter et al. | 65/2 |
| 4,305,742 | | 12/1981 | Barch et al. | 65/3.43 |
| 4,403,744 | | 9/1983 | Reese et al. | 242/18 G |
| 4,526,598 | | 7/1985 | Reese et al. | 65/3.1 |
| 4,542,106 | | 9/1985 | Sproull | 501/38 |
| 4,692,178 | | 9/1987 | Smith, Jr. et al. | 65/2 |
| 4,927,869 | | 5/1990 | Dana et al. | 523/502 |
| 5,054,705 | | 10/1991 | Smith | 242/42 |
| 5,509,765 | * | 4/1996 | Albin . | |

(List continued on next page.)

FOREIGN PATENT DOCUMENTS 45-33373 * 10/1970 (JP) ..... 65/500

OTHER PUBLICATIONS

*The Manufacturing Technology of Glass Fibres*, by K. L. Loewenstein (3rd Ed 1993) pp. 237–291.

*The Manufacturing Technology of Glass Fibres*, by K. L. Loewenstein (3rd Ed 1993) pp. 85–107 and 115–235.

*The Manufacturing Technology of Glass Fibres*, by K. L. Loewenstein (3rd Ed 1993) pp. 30–44, 47–60, 115–122 and 126–135.

*The Manufacturing Technology of Glass Fibres*, by K. L. Loewenstein (3rd Ed 1993) p. 25.

*Primary Examiner*—John Hoffmann
(74) *Attorney, Agent, or Firm*—Andrew C. Siminerio

(57) ABSTRACT

The present invention provides an apparatus for forming fiber strands comprising a fiber forming device, a gathering shoe device and a winder device, the improvement comprising a gathering shoe device which includes at least one gathering shoe having an annular groove for receiving the fibers from the fiber forming device, the gathering shoe having a generally circular cross section at the annular groove and a diameter at the annular groove ranging from about 2.54 to about 6.35 mm. Another aspect of the present invention is a gathering shoe comprising a rod member having a longitudinal axis; and a groove extending circumferentially about the rod member, wherein the rod member has a diameter at the groove in the range of about 2.54 to about 6.35 mm. Still, another aspect of the present invention is a method of forming fiber strands comprising the steps of attenuating fibers, gathering the fibers into at least one strand on a gathering shoe, and winding the strand, wherein the strand forming imparts a tension in the fibers, the improvement comprising the step of gathering the fibers on a gathering shoe having an annular groove for receiving the fibers, a generally circular cross section at the annular groove and a diameter at the annular groove ranging from about 2.54 to about 6.35 mm to reduce the strand tension.

16 Claims, 4 Drawing Sheets

U.S. PATENT DOCUMENTS

| | | | | |
|---|---|---|---|---|
| 5,626,703 | * | 5/1997 | Tomita . | |
| 5,789,329 | | 8/1998 | Eastes et al. | 501/36 |
| 5,883,021 | | 3/1999 | Beer et al. | 442/172 |
| 5,883,023 | | 3/1999 | Martine et al. | 442/331 |
| 5,908,689 | | 6/1999 | Dana et al. | 428/219 |
| 5,957,402 | * | 9/1999 | McEathron . | |

* cited by examiner

SMALL DIAMETER GATHERING SHOE FOR GLASS FIBER FORMING

BACKGROUND OF THE INVENTION

1. Field of the Invention

The instant invention relates to a gathering shoe arrangement for a continuous glass fiber forming operation.

2. Technical Considerations and Prior Art

Glass fibers are commonly formed by attenuating molten glass through orifices in a bushing. The fibers are then drawn across an applicator, which coats at least a portion of the fiber surface with a sizing composition. The coated fibers are then gathered into one or more discrete strands by gathering shoes and wound on a winding machine into a forming package. As a result of the glass fibers being drawn across the gathering shoes to form the strands, and in particular the friction developed between the fibers and the gathering shoes as the fibers contact the shoe, tension is added to the fibers. This additional tension in the fibers can result in degradation of the glass fibers as well as increased fiber breakage during the fiber forming and winding operation. Conversely, if tension can be reduced, the quality of the glass fiber product will improve.

The following patents disclose modified gathering shoe configurations.

U.S. Pat. No. 3,999,970 discloses a gathering shoe configured to reduce the wear of the shoe. The gathering shoe is formed from porous material, such as graphite. A gaseous fluid is introduced into a central cavity within the shoe and forced through slots in the porous material to the surface of the shoe such that the glass fiber strands formed by the shoe ride on a gaseous fluid cushion.

U.S. Pat. No. 4,526,598 discloses a gathering shoe which reduces the wrapping of fibers and/or strands around the shoe. The gathering shoe has an annular groove about its periphery. The groove includes plurality of holes radiating from the groove surface inward toward the center of the shoe.

It would be advantageous to reduce the tension in the fibers so as to improve the quality of the glass fiber strands.

SUMMARY OF THE INVENTION

The present invention provides an apparatus for forming fiber strands comprising a fiber forming device, a gathering shoe device and a winder device, the improvement comprising a gathering shoe device which includes at least one gathering shoe having an annular groove for receiving the fibers from the fiber forming device, the gathering shoe having a generally circular cross section at the annular groove and a diameter at the annular groove ranging from about 2.54 to about 6.35 mm.

Another aspect of the present invention is an apparatus for forming fiber strands comprising a fiber forming device, a gathering shoe device and a winder device, the improvement comprising at least one gathering shoe having an annular groove for receiving the fibers from the fiber forming device, wherein the gathering shoe is sized such that there is a line of contact between the fibers within the annular groove and the gathering shoe ranges from about 0.0661 to about 1.661 mm.

Yet, another aspect of the present invention is a gathering shoe comprising a rod member having a longitudinal axis; and a groove extending circumferentially about the rod member, wherein the rod member has a diameter at the groove in the range of about 2.54 to about 6.35 mm.

Still, another aspect of the present invention is a method of forming fiber strands comprising the steps of attenuating fibers, gathering the fibers into at least one strand on a gathering shoe, and winding the strand, wherein the strand forming imparts a tension in the fibers, the improvement comprising the step of gathering the fibers on a gathering shoe having an annular groove for receiving the fibers, a generally circular cross section at the annular groove and a diameter at the annular groove ranging from about 2.54 to about 6.35 mm to reduce the strand tension.

Another aspect of the present invention is a method of forming fiber strands comprising the steps of attenuating fibers, gathering the fibers into at least one strand on a gathering shoe, and winding the strand, wherein the strand forming imparts a tension in the fibers, the improvement comprising the step of providing a line of contact between the fibers and the gathering shoe ranging from about 0.0661 to about 1.661 mm.

DETAILED DESCRIPTION OF THE INVENTION

The present invention will be discussed generally in the context of its use in the forming and winding of glass fibers. However, one skilled in the art should understand that the present invention is useful in the processing of other fibers as discussed below.

Figure 1:
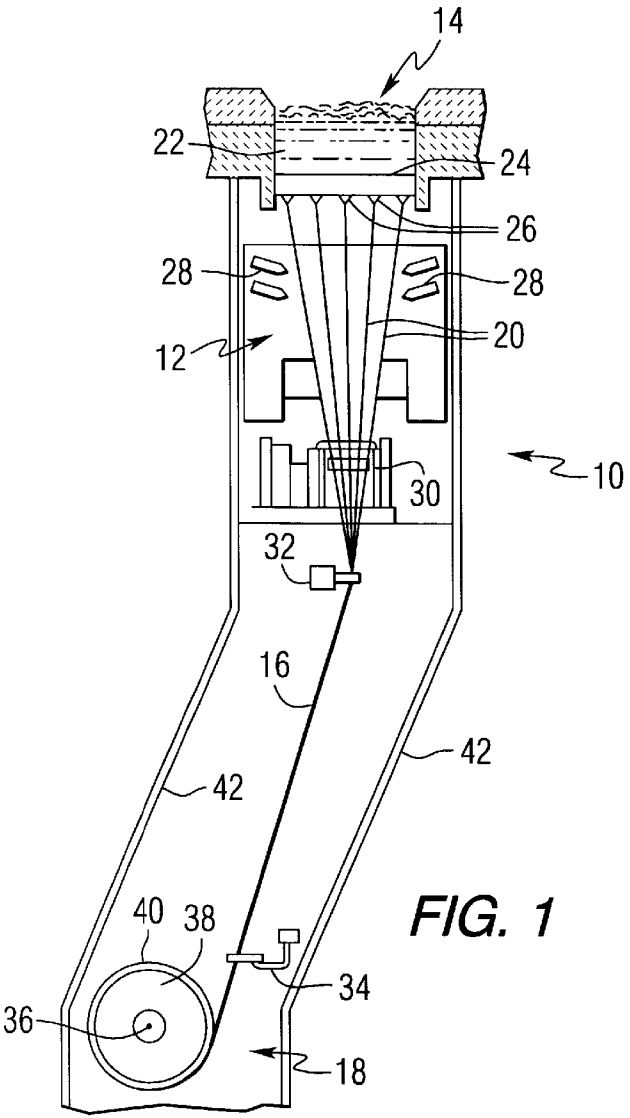
FIG. 1 is an elevational view of a forming station of a typical glass fiber forming operation, with portions removed for clarity.

Referring to FIG. 1, a forming station 10 of a glass fiber forming operation includes a forming apparatus 12 having a strand supply device 14 for supplying at least one strand 16 to a winder 18. As used herein the term "strand" means a plurality of continuous fibers 20. Fibers 20 are supplied from a glass melting furnace or forehearth (not shown) containing a supply of a fiber forming molten glass 22 and having a metal bushing 24 attached to the bottom of the forehearth. The molten glass 22 is drawn through a plurality of nozzles 26 in the bushing 24 and attenuated by the winder 18 to form glass fibers 20. Water sprays 28 can be used to spray water at the newly formed fibers 20 to cool them after being drawn from the bushing 24. For clarity in the drawing, the ceramic materials, cooling tubes and fins surrounding the metal bushing have been omitted. Alternatively, the forming apparatus 12 can be, for example, a forming device for synthetic textile fibers or strands in which fibers are drawn from nozzles, such as but not limited to a spinneret, as is known to those skilled in the art. Typical forehearths and glass fiber forming arrangements are shown in K. L. Loewenstein, *The Manufacturing Technology of Glass Fibres*, (Third Edition 1993) at pages 85–107 and pages 115 to 235, which is hereby incorporated by reference.

The glass fibers can be formed from any type of fiberizable glass composition known to those skilled in the art including those prepared from fiberizable glass compositions such as "E-glass", "A-glass", "C-glass", "D-glass", "R-glass", "S-glass" and E-glass derivatives. As used herein "E-glass derivatives" means glass compositions which include minor amounts of fluoride and/or boron, and preferably are fluorine-free and/or boron-free. Furthermore, as used herein, "minor" means less than one weight percent fluorine and less than five weight percent boron. Preferred glass fibers are formed from E-glass and E-glass derivatives. Such compositions are well known to those skilled in the art. If additional information is needed, such glass compositions as well as fiberization methods are disclosed in Loewenstein at pages 30–44, 47–60, 115–122 and 126–135 and U.S. Pat. No. 4,542,106 (see column 2, line 67 through column 4, line 53) and U.S. Pat. No. 5,789,329 (column 2, line 65 through column 4, line 24), which are hereby incorporated by reference.

The glass fibers can have a nominal filament diameter ranging from about 5.0 to about 35.0 micrometers (corresponding to a filament designation of D through U and above). For further information regarding nominal filament diameters and designations of glass fibers, see Loewenstein at page 25, which is hereby incorporated by reference.

The present invention is also useful in forming fibers or strands of materials other than glass fibers ("non-glass fibers"). Suitable non-glass fibers which can be formed using in the present invention are discussed at length in the *Encyclopedia of Polymer Science and Technology*, Vol. 6 (1967) at pages 505–712, and U.S. Ser. No. 08/828,212 (now U.S. Pat. No. 5,883,023) at page 15, line 21 through page 17, line 10, which are hereby incorporated by reference.

Typically, after the glass fibers 20 are drawn from the bushing 24, they are contacted with an applicator 30 to apply a coating or sizing composition to the surfaces of the glass fibers 20 to protect the fiber surface from abrasion during processing. As used herein, the terms "size", "sized" or "sizing" refer to the aqueous composition commonly applied to the fibers 20 immediately after formation. Typical sizing compositions can include as components, among other constituents, film-formers, lubricants, coupling agents, emulsifiers and water. Non-limiting examples of sizing compositions that can be used in the present invention are disclosed in assignee's U.S. Pat. No. 3,997,306 (see column 4, line 60 through column 7, line 57); U.S. Pat. No. 4,305,742 (see column 5, line 64 through column 8, line 65) and U.S. Pat. No. 4,927,869 (see column 9, line 20 through column 11, line 19), and U.S. Ser. No. 08/787,735 now U.S. Pat. No. 5,908,689 (see page 7, line 1 through page 12, line 13 and page 28, line 15 through page 39, line 10) and Ser. No. 08/984,4 now U.S. Pat. No. 5,883,021 (see page 10, line 1 through page 15, line 17), which are hereby incorporated by reference. Additional information and further non-limiting examples of suitable sizing compositions are set forth in Loewenstein at page 237–291, which is hereby incorporated by reference.

A gathering device 32 mounted at the forming station 10 in any convenient manner is used to gather selected groups of fibers 20 to form one or more strands 16. The strands 16 typically have about 100 to about 15,000 fibers per strand, and preferably about 200 to about 7,000 fibers and are drawn through the gathering device 32 at speeds of about 2,500 to about 18,000 feet per minute (about 762 to about 5486 meters per minute). Although not limiting in the instant invention, the particular gathering device 32 shown in FIG. 2, forms four strands 16, but it should be appreciated that fibers 20 may be divided into fewer or more strands, preferably 1 to about 20 strands, and more preferably 1 to about 16 strands. Strands 16 can also be formed from fibers drawn from a plurality of adjacent bushings.

The forming apparatus 12 also includes spiral 34 for traversing the strands 16 along the length of the axis of rotation 36 of a rotatable collet 38 of the winder 18 during winding of the strand 16 about the surface 40 of the collet 38 to produce a forming package. Sidewalls 42 are positioned to generally enclose the forming station 10 and isolate the bushing 24, applicator 30, gathering device 32, strands 16 and fibers 20 from similar elements in adjacent forming stations. Sidewalls 42 also provide support for other devices that can be used at the forming station 10 in forming the strands 16.

Figure 2:
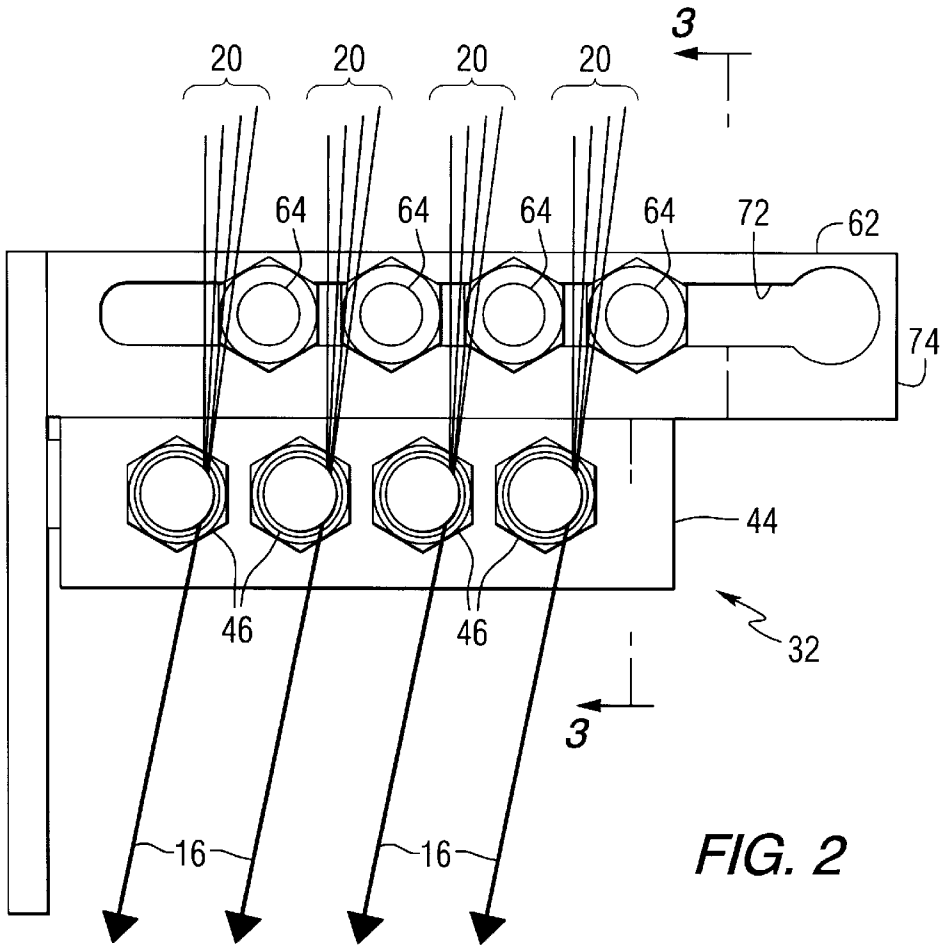
FIG. 2 is an elevational view of a glass fiber gathering device incorporating features of the present invention, with portions removed for clarity.

Turning to the gathering device 32, the particular arrangement illustrated in FIG. 2 is commonly referred to as a four-way splitter, i.e. gathering device 32 uses a gathering shoe arrangement 44 that divides the fibers 20 into four distinct strands 16. The gathering shoe arrangement 44 includes a plurality of gathering shoes 46 configured to bundle the fibers 20 and form individual strands 16, will be discussed later in more detail. Although not limiting in the present invention, in the particular gathering device 32 illustrated in FIG. 3, the gathering shoe is a rod member having a generally circular cross section and include a circumferential groove 47 along shoe surface 51 to gather the fibers 20 to form strands 16. Each gathering shoe 46 is fitted within a threaded lower guide 48 and secured thereto by a compression fitting 50 which presses a portion of the guide 48 against a portion of shoe surface 51 of the gathering shoe 46. Each shoe 46 and guide 48 is received within a corresponding cavity 52 of a splitter block 54. Although not limiting in the present invention, in the particular embodiment of the invention shown in FIG. 3, block 54 includes 2 housing sections that are joined in any convenient manner, e.g. screws or bolts. Although not required, each gathering shoe 46 can be rotated about its longitudinal axis 56 while it collects the fibers 20 and forms the individual strands 16. This can be accomplished in any convenient manner well known to those skilled in the art using, such as but not limiting in the present invention, a timing belt or gear arrangement. More specifically, in the particular gathering device 32 shown in FIG. 3, each lower guide 48 also includes a shaft 58 that extends from the guide 48 into the block 54 where it is captured by a gear 60 and secured thereto in any convenient manner, for example set screws. The gears 60 are interconnected in any convenient manner and at least one of the gears is connected to a drive (not shown) which rotates the gathering shoes 46 at a desired rate. It should be appreciated that the gears can be arranged such that all of the gathering shoes 46 rotate in the same direction or selected shoes 46 can rotate in opposite directions. In addition, the shoes 46 can rotate in either direction relative to the direction that the fibers 20 pass over the shoes 46. As an alternative, the gears 60 may be interconnected, for example, with a timing belt that rotates all of the shoes 46 in the same direction. Although not limited in the present invention, the gathering shoes 46 should be rotated at a rate of about 0.25 to about 15 RPMs, and preferably at a rate of about 1 to about 8 RPMs.

Figure 3:
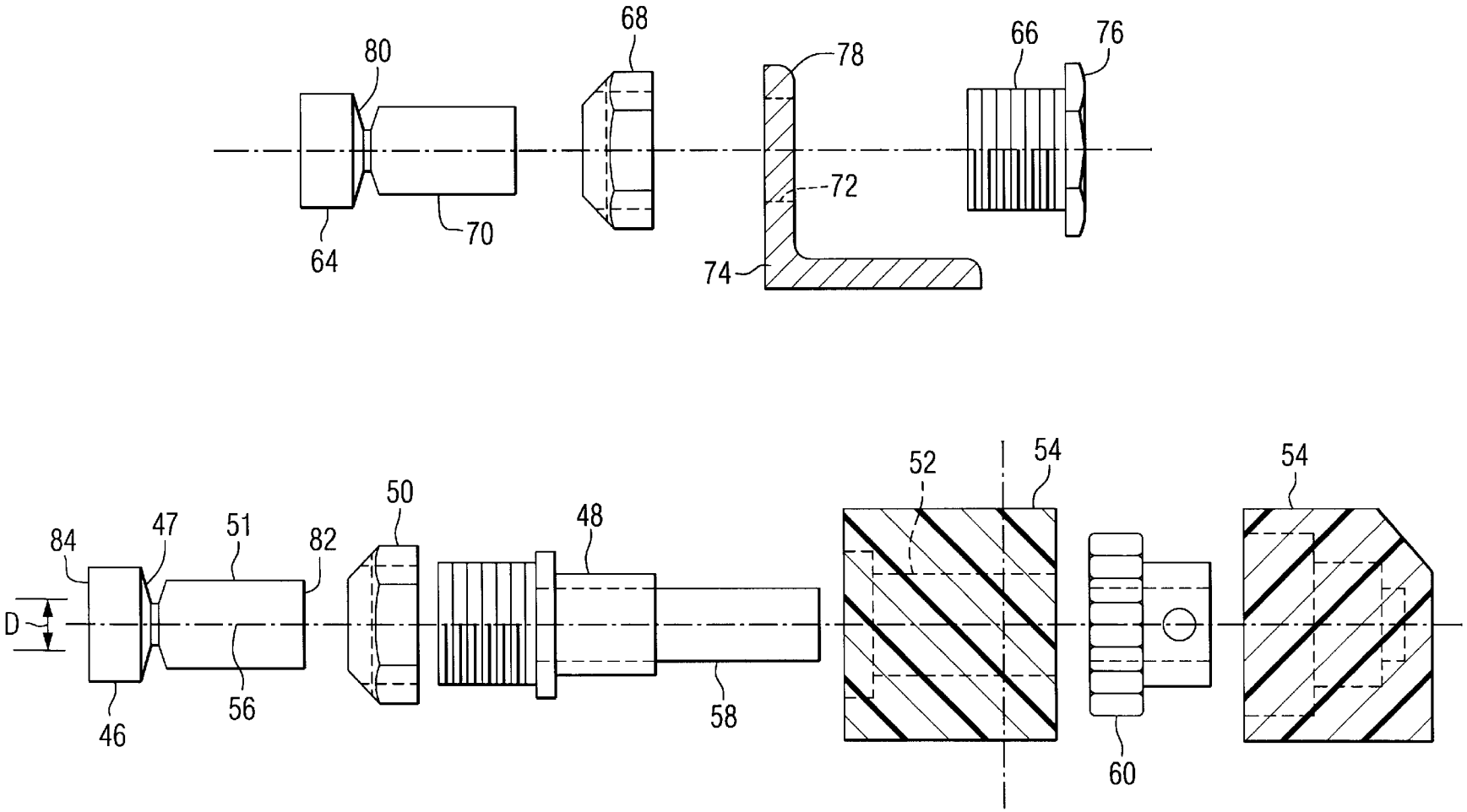
FIG. 3 is an expanded view taken along line 3—3 of FIG. 2, with portions removed for clarity.

It should be appreciated that although shoe 46 as shown in FIGS. 2 and 3 is a generally rod-like member with a generally circular cross-section configuration, shoe 46 can have other configurations, e.g. rectangular or octagonal. However, it is preferred that the cross section of the shoe 46 at groove 47 remain generally circular and the shape of the shoe be such that allows the relative contact point between the fibers 20 and the shoe 46 to remain constant as the shoe is rotated.

Although not required, the particular embodiment of the gathering device 32 illustrated in FIG. 2 also includes a guide arrangement 62 which includes a plurality of guide shoes 64. The shoes 64 are configured and positioned such that prior to fiber attenuation, they direct groups of fibers 20 into the appropriate gathering shoe 46 and during the fiber attenuation and forming operation, they have minimal contact with fibers 20. Guide shoes 64 are mounted on the gathering device 32 in any convenient manner. Although not limiting in the present invention, in the particular embodiment illustrated in FIGS. 2 and 3, each guide shoe 64 is fitted within a threaded upper guide 66 and secured thereto by a compression fitting 68 which presses a portion of the guide 66 against the outer surface 70 of the guide shoe 64. The guide 66 extends through a slot 72 in guide 74, which in FIG. 3 is shown as an angle member, and fixed thereto by fitting 68, with flange 76 of the guide 66 and fitting 68 capturing the flange 78 of the angle member guide 74 therebetween. The slot 72 generally extends along the length of the angle member guide 74 so as to allow each guide shoe 64 to be positioned as required along the gathering device 32. In the particular guide shoe configuration shown in FIG. 3, each guide shoe 64 includes a groove 80 that helps retain the unattenuated fibers 20 within a corresponding gathering shoe 46 prior to fiber attenuation.

The guide shoe mounting arrangement 62 discussed above allows for easy positional adjustment of the shoes 64 during glass fiber production. More specifically, although fibers 20 are drawn along the groove 80 surface as they are initially grouped to form the strands 16 as discussed above, it is preferred that the guide shoes 64 have minimal, if any, contact with the fibers 20 as the fibers 20 are drawn from the bushing 24 and strand 16 is wrapped around collet 38 by winder 18 during the actual fiber forming operation. The above guide shoe mounting arrangement 62 provides quick and simple positional adjustment of shoes 64 so that the shoe 64 can be positioned at a location such that the fibers are maintained within the groove 80 prior to fiber attenuation but make minimal contact with the shoe 64 during fiber attenuation.

If required, the guide shoes 64 can be mounted within the gathering device in a manner that allows the shoes 64 to rotate during the fiber forming operation using, for example and without limiting the present invention, a mounting and rotating arrangement similar to those discussed earlier in connection with gathering shoes 46.

Although not required, the guide shoe 64 may be made of the same material and be configured similarly to the gathering shoe 46.

Figure 4:
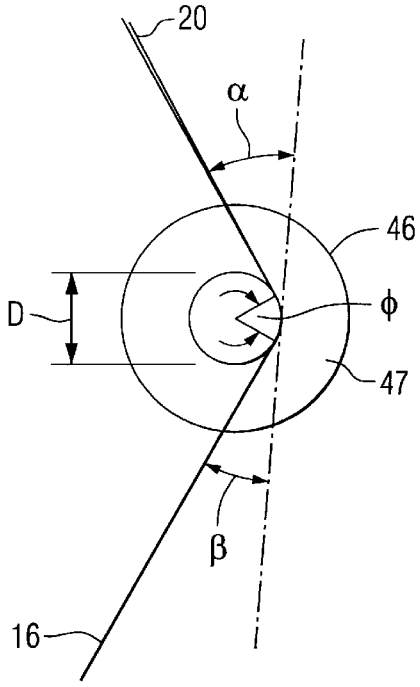
FIG. 4 is a schematic view illustrating the fibers as they are formed into strands by the gathering shoe of the present invention.

FIG. 4 illustrates the amount of contact between the fibers and the surface of groove 47 of gathering shoe 46 of the present invention at the base of the groove. The amount of contact is determined by the wrap angle $\phi$ and the effective diameter D of the gathering shoe 46. As used herein, "effective diameter" means the diameter of the shoe at the point where the fibers 20 are bundled together to form a strand 16. In the embodiment of the invention illustrated in FIGS. 2 and 3, effective diameter D is measured at the base of groove 47 as shown in FIG. 4. As will be discussed, reducing the amount of contact between the fibers 20 and gathering shoe 46 reduces the tension in strands 16. This in turn improves strand quality and reduces fiber breakage. In addition, the winding speed, i.e. the speed at which the strands 16 are wound onto collet 38, may be increased to take advantage of the reduced strand tension. Referring to FIG. 4, the greater the approach angle $\alpha$ of the fibers 20 from the bushing 24 (not shown in FIG. 4) to the gathering shoe 46, the greater the wrap angle $\phi$. Similarly, the greater the delivery angle $\beta$ from the gathering shoe 46 to the spiral 34 (not shown in FIG. 4), the greater the wrap angle $\phi$. Referring to FIGS. 1 and 4, it is apparent that the relative position of the bushing 24, gathering device 32, spiral 34 and winder 18 effect the wrap angle $\phi$. However, as will be appreciated, the present invention minimizes the impact of the relative positioning of these fiber forming components on the strand tension. More specifically, in the particular embodiment of the present invention illustrated in FIG. 3, the gathering shoe 46 is basically cylindrically shaped with a circumferential groove 47 which collects a selected number of fibers 20 and forms a strand 16. The effective diameter D of the gathering shoe 46 at the groove 47 as illustrated in FIGS. 3 and 4 is preferably between about 0.1 to about 0.25 inches (about 2.54 to about 6.35 mm) and more preferably between about 0.12 to about 0.17 inches (about 3.05 to about 4.32 mm). It is expected that the wrap angle $\phi$ will vary from about 3° to about 30°, preferably between about 5° to about 25° depending on the relative positions of the bushing 24, gathering device 32, spiral 34 and winder 18, as well as the number of fiber strands to be formed. For example, in a four-way splitter, it is expected that the wrap angle $\phi$ can vary between about 5° to about 15°; in a six-way splitter, it is expected that the wrap angle $\phi$ can vary between about 5° to about 19°; and in an eight-way splitter, it is expected that the wrap angle $\phi$ can vary between about 5° to about 22°. Based on an effective diameter D at groove 47 of shoe 46 of between about 0.1 to about 0.25 inches, the line of contact between strand 16 and gathering shoe 46 at the base of groove 47 (i.e. $[\phi/360]D\pi$) will vary between about 0.00261 to about 0.0654 inches (about 0.0661 to about 1.661 mm), and preferably between 0.00436 to about 0.0545 inches (about 0.111 to about 1.384 mm). For a preferred effective diameter D of gathering shoe 46 between about 0.12 to about 0.17 inches, the line of contact will vary between about 0.00314 to about 0.0445 inches (about 0.0798 to about 1.130 mm), and preferably between about 0.00524 to about 0.0371 inches (about 0.133 to about 0.942 mm).

The gathering shoes 46 are made of a material that resists the abrasive action of the glass fibers 20 rubbing against the surface of groove 47 while at the same time not adversely effecting the properties of the glass fiber 20, i.e. degrade the fiber surface and lead to reduced surface quality and potential filament breakage. In addition, because of the environment in which it is being used and potential for molten glass beads contacting the shoe 46, the shoe material should also exhibit high temperature resistance. Depending on the material, it is may extruded and machined or molded to shape. Without limiting the present invention, the shoes 46 may be made from graphite, brass, ceramics, phenolic resins or high temperature and abrasion resistant polymers. One type of graphite that may be used is CMG grade graphite which is fine grain graphite available from Pure Carbon Company, St. Mary's, Pa. One type of polymer that may be used is TORLON® 4301 synthetic polymer available from Amoco Polymers, Inc., Alpharetta, Ga.

Figure 5:
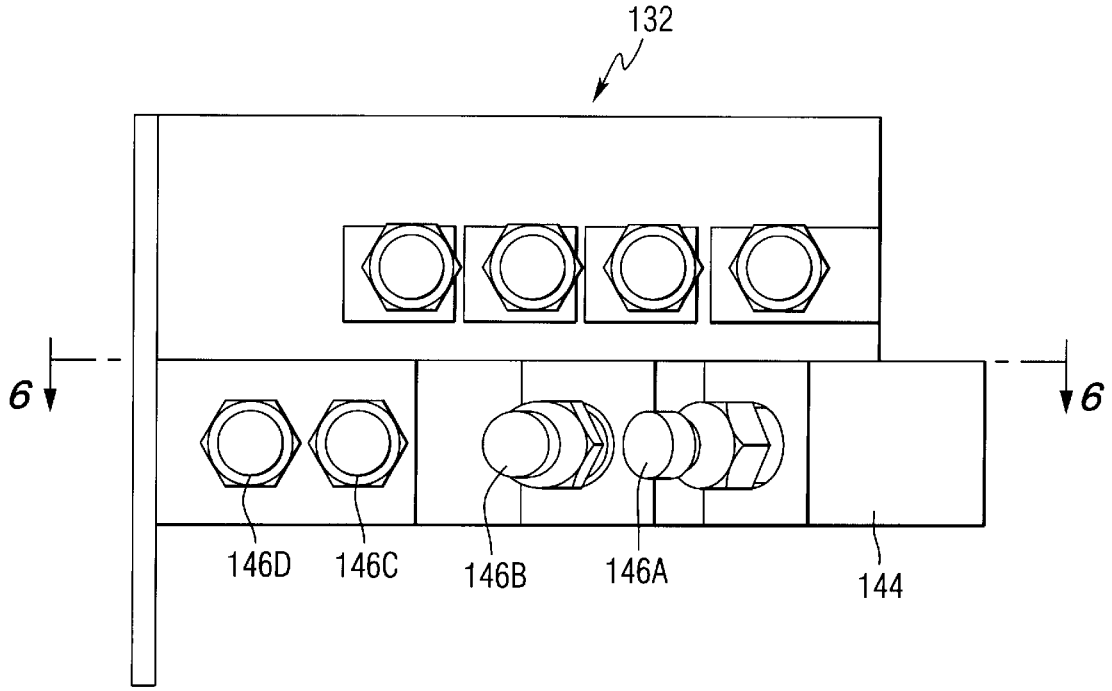
FIG. 5 is an elevational view of an alternate embodiment of a gathering shoe arrangement incorporating features of the present invention, with portions removed for clarity.
Figure 6:
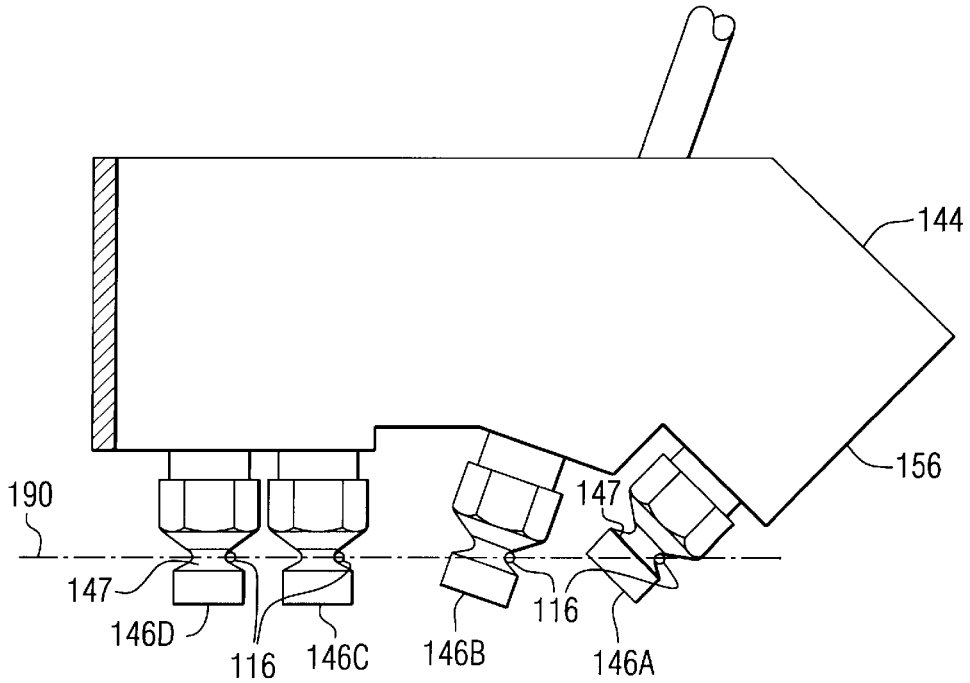
FIG. 6 is a view taken along line 6—6 of FIG. 5.

If required, based on the position of the collet relative to the gathering shoe, selected gathering shoes can be mounted at an angle relative to the remaining gathering shoes to better maintain the strand within the groove of that particular shoe. More specifically, referring to FIGS. 5 and 6, in this particular embodiment of the present invention, gathering device 132 includes a gathering shoe arrangement 144 having gathering shoes 146A and 146B which are positioned within block 154 in a manner such that they are angularly offset from remaining gathering shoes 146C and 146D. This arrangement allows the strands 116 (shown only in FIG. 6) collected by shoes 146A and 146B to be directed to a selected portion of the collet while ensuring that the strands remain within the gathering shoe grooves 147. In addition, although not required, in the particular gathering shoe arrangement illustrated in FIG. 5, shoes 146A and 146B are oriented such that all four strands 116 are aligned along a common centerline 190 when positioned within the respective shoe grooves 147.

In one particular embodiment of the invention, the shoe 46 as illustrated in FIG. 3 was formed from a 1 inch (25.4 millimeters) long by 0.5 inch (12.7 millimeters) diameter piece of TORLON® 4301 polymer. Section 82 of the gathering shoe 46 was reduced to a 0.375 inch (9.53 mm) diameter to allow for close spacing of the lower guides 48. Head section 84 remained at a 0.5 inch (12.7 millimeters) diameter. Groove 47 was formed in shoe 46 such that the groove had a 0.0312 inch (0.794 mm) radius at its base and a 35 degree included angle. The effective diameter D of the shoe 46 at groove 47 was 0.165 inches (4.92 mm).

It should be appreciated that as the gathering shoe 46 is used in production, the fibers 20 will wear the groove surface, resulting in increased friction between the fibers 20 and the shoe surface and distortion of the original groove configuration. As a result, the shoe 46 must be periodically redressed to smooth and reshape the groove surface. Depending on the number and size of the glass fibers, type of glass fiber, the production rate, strand tension and the shoe material, it is expected that the gathering shoes 46 will last between about 24 to about 72 hours of production or longer before redress or replacement is needed. As the effective diameter D of the gathering shoe 46 gets smaller, care must be taken during redressing to prevent breakage of the shoe 46, especially when the gathering shoe 46 is made of a nonmetallic material. It is expected that the gathering shoes 46 can be used and reused at least until the effective diameter D reaches about 0.120 inches (3.048 mm). With proper maintenance procedures, it is expected that the effective diameter D can be as small as about 0.10 inches (2.54 mm).

If desired, the gathering shoe 46 can be reinforced to prevent premature breakage and allow for further reduction in the effective diameter D of the shoe 46 at the groove 47. For example, and without limiting the instant invention referring to FIG. 7, a gathering shoe 146 similar to gathering shoe 46 can be reinforced by providing a rigid member 100 within the shoe 146 along its longitudinal axis 156, at least in the vicinity of groove 147. In the particular embodiment of the invention illustrated in FIG. 7, a hole 196 was drilled the length of shoe 146 and a 0.071 inch (1.803 mm) diameter steel needle 100 was positioned within the hole. The needle 100 was secured within hole 196 by an epoxy adhesive (not shown). When providing a reinforcing member within the shoe 146, additional care must be taken to ensure that repeated use and redressing of the shoe does not inadvertently expose the reinforcing member, which in turn can result in surface degradation of the fibers 20 as they pass over and rub against the shoe and possibly break.

Figure 7:
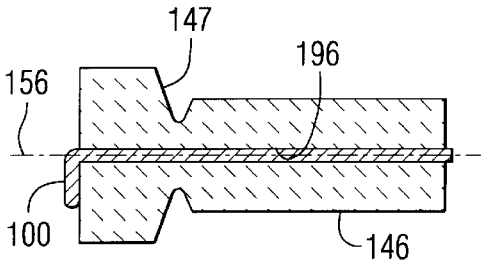
FIG. 7 is a cross-sectional view of an alternate embodiment of a gathering shoe incorporating features of the present invention.
Figure 8:
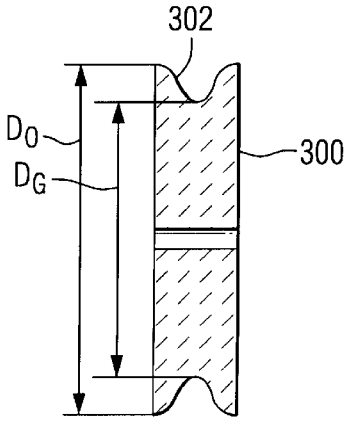
FIG. 8 is a cross-sectional view of a prior art gathering shoe.

Reinforced gathering shoes 146 as shown in FIG. 7 were tested at a forming station of a glass fiber forming operation to determine the reduction in strand tension. More specifically, the gathering shoe 146 was made from CMG grade graphite and measured 1 inch long by 0.375 inch diameter (25.4 mm by 9.53 mm). The effective diameter D at the base of groove 147 was 0.125 inches (3.18 mm). The fiber forming operation was producing D450 glass fibers using a conventional shoe 300 as shown in FIG. 8. The shoe 300 was made from P5 grade graphite available from Pure Carbon Company and had an outer diameter $D_O$ of 1 inch (25.4 mm) and a diameter $D_G$ measured at the base of groove 302 of 0.625 inches (15.88 mm). The strand tension was measure beneath the shoe position corresponding to the leftmost shoe in FIG. 2 using a Rothchild Electronic Tensiometer, Model 400MMT. The strand had a wrap angle of about 15°. Next, a shoe 146 was positioned in close proximity to the conventional shoe 300 and subsequently moved by hand toward the fibers until the fibers were no longer contacting shoe 300 but rather were being collected by shoe 146. The strand tension was measured again. It was found in this particular test that shoe 146 reduced the average strand tension by about 22 percent when compared to conventional gathering shoe 300. As used herein, "average strand tension" means the average of the tension in each strand as measures just below the gathering shoe 46.

A second test was conducted to measure and compare the average strand tension for the gathering shoe 146 as shown in FIG. 7 and discussed above and the conventional shoe 300 as shown in FIG. 8 and discussed above. The shoes were used on a four-way splitter to produce four forming packages of D450 glass fibers. The forming operation was first run using gathering shoes 300 and the strand tension was measured beneath each shoe using a Rothchild Electronic Tensiometer Model 400MMT. Shoes 300 were then replaced with shoes 146 and the strand tension was measured again. It was found in this particular test that shoes 146 reduced the average strand tension between about 10 to about 27 percent, depending on the wrap angle of the strand, which in turn depended, in part, on the particular position of the shoe 46, when compared to the conventional gathering shoes 300.

By reducing the average strand tension, the forming operation can be modified to increase yield. More specifically, the winding speed can be increased to a speed that raises the average strand tension from the lower tension level associated with the use of the gathering shoes 46, 146, to the tension level typically associated with the use of conventional gathering shoe designs. The increased winding speed will result in a higher yield. As an alternative, the winding speed may be maintained at its original speed but because the average strand tension has been lowered, it is expected that there will be fewer fiber breaks and thus the quality of the fiber strand will be improved.

There are other advantages to using the gathering shoe of the present invention. For example, because the shoe imparts less tension in the strand, its overall contribution to the strand tension is less, resulting in more uniform and consistent strand tension. This in turn results in more consistent build of the forming packages on the winder. In addition, because the strands have a lower tension and the tension is more consistent, less sizing is lost as the glass fibers pass through the gathering shoe. This results in a more consistent fiber coating.

It will be appreciated by those skilled in the art that changes could be made to the embodiments described above without departing from the broad inventive concept thereof. It is understood, therefore, that this invention is not limited to the particular embodiments disclosed, but it is intended to cover modifications, which are within the spirit and scope of the invention, as defined by the appended claims.

I claim:

1. In an apparatus for forming fiber strands comprising a fiber forming device, a gathering shoe device and a winder device, the improvement comprising a gathering shoe device which includes at least one gathering shoe having an annular groove for receiving the fibers from the fiber forming device, the gathering shoe having a generally circular cross section at the annular groove and a diameter at the annular groove ranging from about 2.54 to about 6.35 mm.

2. The apparatus according to claim 1 wherein the diameter of the at least one gathering shoe at the annular groove ranges from about 3.05 to about 4.32 mm.

3. The apparatus according to claim 1 wherein the at least one gathering shoe is a generally cylindrically shaped, rod-like member.

4. The apparatus according to claim 1 wherein the at least one gathering shoe is made of a material selected from the group consisting of graphite, brass, ceramics, phenolic resins, and high temperature, abrasion resistant polymers.

5. The apparatus according to claim 1 wherein the at least one gathering shoe includes a reinforcing member extending along the longitudinal axis of the gathering shoe, at least in the vicinity of the annular groove.

6. The apparatus according to claim 1 further including a drive arrangement to rotate the at least one gathering shoe about its longitudinal axis.

7. The apparatus as in claim 1 wherein the gathering shoe device includes a plurality of gathering shoes each having an annular groove for receiving the fibers from the fiber forming device, the gathering shoes each having a generally circular cross section at the annular groove and a diameter at the annular groove ranging from about 2.54 to about 6.35 mm.

8. The apparatus according to claim 1 wherein a line of contact between the fibers within the annular groove and the gathering shoe ranges from about 0.0661 to about 1.661 mm.

9. The apparatus according to claim 8 wherein the line of contact between the fibers within the annular groove and the gathering shoe ranges from about 0.0798 to about 1.130 mm.

10. The apparatus according to claim 1 wherein the at least one gathering shoe is positioned relative to the fiber forming device and the winding device such that a wrap angle of the fibers about the gathering shoe within the annular groove ranges from about 3° to about 30°.

11. The apparatus according to claim 10 wherein the wrap angle ranges from about 5° to about 25°.

12. The apparatus according to claim 1 wherein the gathering shoe device includes a plurality of gathering shoes and at least one of the plurality of gathering shoes is angularly offset from other of the plurality of gathering shoes.

13. In an apparatus for forming fiber strands comprising a fiber forming device, a gathering shoe device and a winder device, the improvement comprising at least one gathering shoe having an annular groove for receiving the fibers from the fiber forming device, wherein the gathering shoe is sized and positioned such that there is a line of contact between the fibers and the groove ranges from about 0.0661 to about 1.661 mm.

14. The apparatus according to claim 13 wherein the line of contact ranges from about 0.0798 to about 1.130 mm.

15. In a method of forming fiber strands comprising the steps of attenuating fibers, gathering the fibers into at least one strand with a gathering shoe, and winding the strand, wherein the strand forming imparts a tension in the fibers, the improvement comprising the step of gathering the fibers with a gathering shoe having an annular groove for receiving the fibers, the shoe having a generally circular cross section at the annular groove and a diameter at the annular groove ranging from about 2.54 to about 6.35 mm to reduce the strand tension.

16. In a method of forming fiber strands comprising the steps of attenuating fibers, gathering the fibers into at least one strand with a gathering shoe having an annular groove, and winding the strand, wherein the strand forming imparts a tension in the fibers, the improvement comprising the step of providing a line of contact between the fibers and the groove ranging from about 0.0661 to about 1.661 mm.

* * * * *